United States Patent [19]

Senba et al.

[11] Patent Number: 5,045,891

[45] Date of Patent: Sep. 3, 1991

[54] IMAGE FIXING DEVICE AND ROLLER THEREFOR HAVING A LOW RESISTANCE SURFACE LAYER

[75] Inventors: Hisaaki Senba, Yokohama; Michio Shigenobu, Tokyo; Toshiyuki Hatta, Itami; Masaya Nishi, Osaka, all of Japan

[73] Assignee: Canon Kabushiki Kaisha & Sumitomo Electric Ind., Inc., Tokyo, Japan

[21] Appl. No.: 152,037

[22] Filed: Feb. 3, 1988

[30] Foreign Application Priority Data

Feb. 4, 1987 [JP] Japan ..... 62-025402

[51] Int. Cl.[5] ..... G03C 15/20

[52] U.S. Cl. ..... 355/289; 29/130; 428/408; 428/909; 219/216

[58] Field of Search ..... 355/3 FU, 14 FU, 282-295; 219/216, 469; 432/60; 118/60, 101; 29/130, 132; 361/214; 428/421, 408, 902, 909

[56] References Cited

U.S. PATENT DOCUMENTS

| | | | |
|---|---|---|---|
| 4,159,427 | 6/1979 | Wiedemann | 322/4 X |
| 4,321,033 | 3/1982 | Eddy et al. | 432/60 |
| 4,434,355 | 2/1984 | Inagaki et al. | 219/469 X |
| 4,600,257 | 7/1986 | Fushimoto . | |
| 4,695,925 | 9/1987 | Kodai et al. . | |
| 4,767,348 | 8/1988 | Murakami . | |
| 4,780,603 | 10/1988 | Hamada . | |
| 4,780,793 | 10/1988 | Ohtsuki . | |
| 4,781,612 | 11/1988 | Thrush . | |
| 4,789,347 | 12/1988 | Banjo et al. . | |
| 4,791,608 | 12/1988 | Fushimoto . | |
| 4,878,139 | 10/1989 | Hasegawa et al. . | |

FOREIGN PATENT DOCUMENTS

| | | | |
|---|---|---|---|
| 275091 | 7/1988 | European Pat. Off. . | |
| 3200646 | 8/1982 | Fed. Rep. of Germany | 361/394 |
| 57-205765 | 4/1982 | Japan . | |
| 57-202578 | 11/1982 | Japan . | |
| 59-111667 | 12/1984 | Japan . | |
| 60-107670 | 6/1985 | Japan | 355/3 FU |
| 60-209772 | 10/1985 | Japan | 355/3 FU |
| 61-138272 | 7/1986 | Japan . | |

OTHER PUBLICATIONS

Xerox Disclosure Journal, vol. 5, No. 1, Jan./Feb., 1980 entitled "Filled Fluorobarbon Polymer Coatings For Laminated Articles" by Clifford O. Eddy, Albert E. Schreiber and Donald B. Smith.

*Primary Examiner*—Joan H. Pendegrass

*Attorney, Agent, or Firm*—Fitzpatrick, Cella, Harper & Scinto

[57] ABSTRACT

An image fixing apparatus in which a recording material having an unfixed image through a nip formed between rotatable rollers. At least one of the rollers is provided with a surface layer containing straight-needle like single-crytal fibers.

39 Claims, 6 Drawing Sheets

IMAGE FIXING DEVICE AND ROLLER THEREFOR HAVING A LOW RESISTANCE SURFACE LAYER

FIELD OF THE INVENTION AND RELATED ART

The present invention relates to an image fixing device and a roller therefor usable with a device for fixing a toner image which has been formed by an electrophotographic apparatus or electrostatic recording apparatus.

At present, most widely used device for fixing the toner image is one having a heating roller, wherein a recording member having an unfixed image made of a heat fusable toner, for example, is passed through a nip formed between rollers, at least one of which is heated, whereby the toner image is heated and pressed to be fixed. In this system, the heated roller is directly contacted to the toner image, so that the efficiency of heat transfer is excellent. However, it involves corresponding problems, against which some measures are taken. One of the problems is "off-set", that is, the toner is partly transferred to the roller, which is not desirable. The off-set is divided into two types one is a low temperature off-set in which the image fixing operation is not sufficient; the other is a high temperature off-set resulting from the increased temperature of the roller. However, the mechanism for the off-set occurrence is not completely clear. In any event, the recent measures against off-set include coating the roller with a releasing resin such as a fluorine resin, mechanically cleaning the roller to remove the off-set toner and applying to the roller a releasing agent such as silicone oil or the like to decrease the amount of the off-set toner itself.

One of the reasons for the production of the off-set toner is considered to be triboelectrification, stemming from the contact of an upper roller with the recording material or with the lower roller, up to several handreds volts to electrostatically attract the charged toner deposited on the recording material to the upper roller. Another measure against the off-set is directed to reduction of the surface potential of the upper roller. From this standpoint, an attempt has been made to lower the electric resistance of the surface layer of the roller made of the releasing resin. Japanese Patent Application Publication 13226/1983 proposes that low-resistance fine amorphous particles such as metal powder or carbon black exhibiting a good electrical conductivity is added to the releasing resin surface layer.

However, the mixing of the low electric resistance power is not enough to sufficiently prevent the triboelectrification, and therefore, the off-set toner production can not be reduced to a satisfactory extent. The inventors have investigated and considered those problems, and concluded as follows.

Referring to FIG. 1, there is shown a sectional view of the roller couple at the nip portion, wherein the upper roller contains the low resistance fine powder mixed thereinto. A recording material 3 such as a sheet of paper having an unfixed toner image T is between an upper roller 1 and the lower roller 2. The toner image T on the recording material 3 is fixed by being pressed and heated in the nip formed between the upper roller 1 and the lower roller 2. At this time, the roller is electrically charged by the friction with the recording material or the toner or the like. On the other hand, the upper roller 1 which is brought into contact with the toner image, is usually coated with a resin coating layer 4 of a fluorine resin such as perfluoroalkoxy (PFA) or polytetrafluoroethylene (PTFE) resin, which shows good surface releasing property. However, such fluorine resins are placed at the most negative charge side in the triboelectric series, that is, they are most easily charged to negative polarity, and when it is subject to friction with the recording material, it is usually charged up to above several handreds volts. Therefore, particularly when the toner is positively charged, the toner is easily transferred to the upper roller by an electrostatic attraction force. When low resistance fine powder 5 is added into the resin layer 4 in an attempt to prevent the negative charging, the fine particles 5 are dispersed in the resin layer 4 in the manner shown in FIG. 1. Macroscopically, the potential of the upper roller decreases down to several tens volts, and correspondingly, the amount of the off-set toner is more or less reduced. However, the amount of off-set toner is still large. Here, looking at the resin layer microscopically, although the low resistance fine particles 5 are dispersed generally uniformly, the fact is that in some portions as indicated by region a, the fine particles are contacted so that the roller surface portion and the core metal 6 is electrostatically contacted, whereas in other portions indicated by a region b the particles are independent without contacts so that the surface portion of the roller is virtually isolated electrically from the core metal 6. A surface portion a' of the region a is electrically connected to the core metal 6, and therefore, the electric charge produced by the friction leaks to the core metal 6, whereby the amount of charge remaining on the roller is small. Therefore, the toner T' disposed opposed to the surface portion a' is not easily transferred to the roller because the electrostatic attraction force is small.

However, the surface portion b' of the region b is virtually insulated, and therefore, the negative charge produced by the friction remains on the roller. Therefore, a strong electrostatic attraction force is produced between the roller and the toner T'' opposed to the surface portion b', resulting in that the toner is easily transferred to the roller. Since there are both the surface portion a' and the surface portion b', the surface potential of the roller seems macroscopically to be lowered, but the toner off-set occurs in at the insulated portions such as the surface regions b'. As a result, the amount of the toner off-set is not so much reduced. As will be expected from the foregoing explanation, one will attempt to increase the amount of the fine particles 5 added to the roller, since increase of region a (surface portions a') reduces the off-set. However, with the increase of the powder content, the fluorine resin content decreases, and therefore, the releasing property is degraded. Accordingly, while the electrostatic off-set is reduced, the off-set resulting from the physical adhesion is increased, so that the off-set is not reduced in total.

As will be understood from the foregoing, it was extremely difficult to reduce the off-set when low resistance fine powder is added to the roller, and when the content thereof is maintained low.

Japanese Laid-Open Patent Application No. 209769/1983 discloses that carbon fibers are added to the surface layer of a fixing roller and that the electrical resistance of the fixing roller can be reduced, and simultaneously, the wear resistance is increased. However, the roller with these usual fibers mixed thereinto is still unsatisfactory in wear resistance, since with repeated image fixing operations, the roller surface is roughened relatively soon by friction. When the roller surface is roughened, the toner is easily deposited onto the surface, which leads to decreased anti-electrification and to easy deposition of the toner to the roller surface due to the adhesiveness of the toner having been deposited on the surface. Additionally, the roller surface contaminated with the toner can be easily wrapped with the recording material having the toner image.

SUMMARY OF THE INVENTION

Accordingly, it is a principal object of the present invention to provide an image fixing device and a roller therefor in which the triboelectrification of the roller is prevented positively and microscopically without degrading the releasability of the roller, whereby the toner off-set is remarkably reduced.

It is another object of the present invention to provide an image fixing device and a roller therefor in which the off-set can be prevented for a long period of time.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4 is a cross-sectional view of a nip portion of an image fixing device according to another embodiment of the present invention.

DESCRIPTION OF THE PREFERRED EMBODIMENTS

Figure 2:
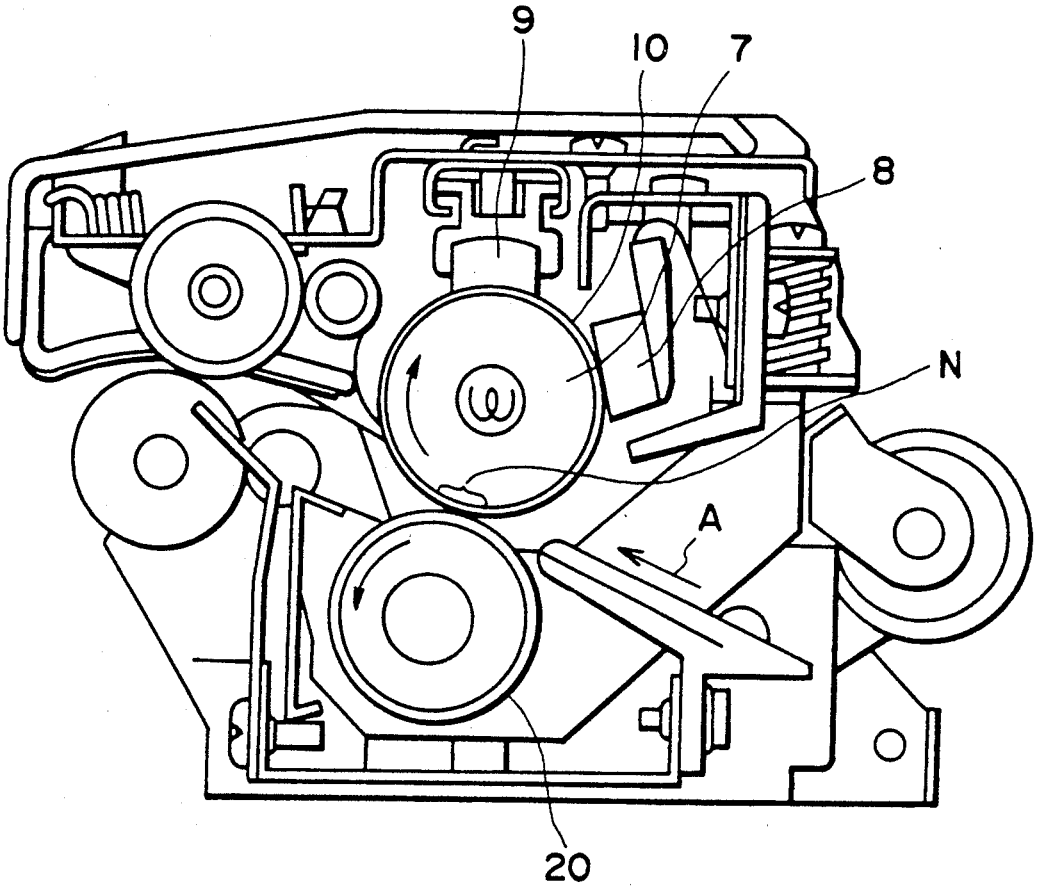
FIG. 2 is a sectional view of an image fixing device according to an embodiment of the present invention.

Referring to FIG. 2, there is shown an image fixing device according to an embodiment of the present invention. The fixing device comprises an upper roller (a first fixing roller) 10 which is contactable to a toner image carried on a recording material and a lower roller (a second fixing roller) 20 having an elastic layer which is press-contacted to the upper roller 10 by an unshown pressing means at least when the image fixing operation is performed. The upper roller 10 includes a surface coating layer of a resin having a releasing property and a heating source 7 for heating the roller. The upper roller 10 and the lower roller 20 are press-contacted to form a nip N having a proper nip width. The rollers are rotated in the direction indicated by arrows by an unshown driving means. The recording material having an unfixed toner image is introduced into the nip N in the direction indicated by an arrow A.

A temperature of the surface of the upper roller 10 is detected by a temperature sensor 8 contacted to the roller 10, and the surface temperature is controlled to be maintained at a predetermined level. Further, the surface of the upper roller 10 is cleaned by a heat-resistive felt pad 9 contacted to the upper roller 10.

In this embodiment, the pressing means and the driving means may be of any conventional type, and therefore, the detailed explanation thereof is omitted for the sake of simplicity.

Figure 3:
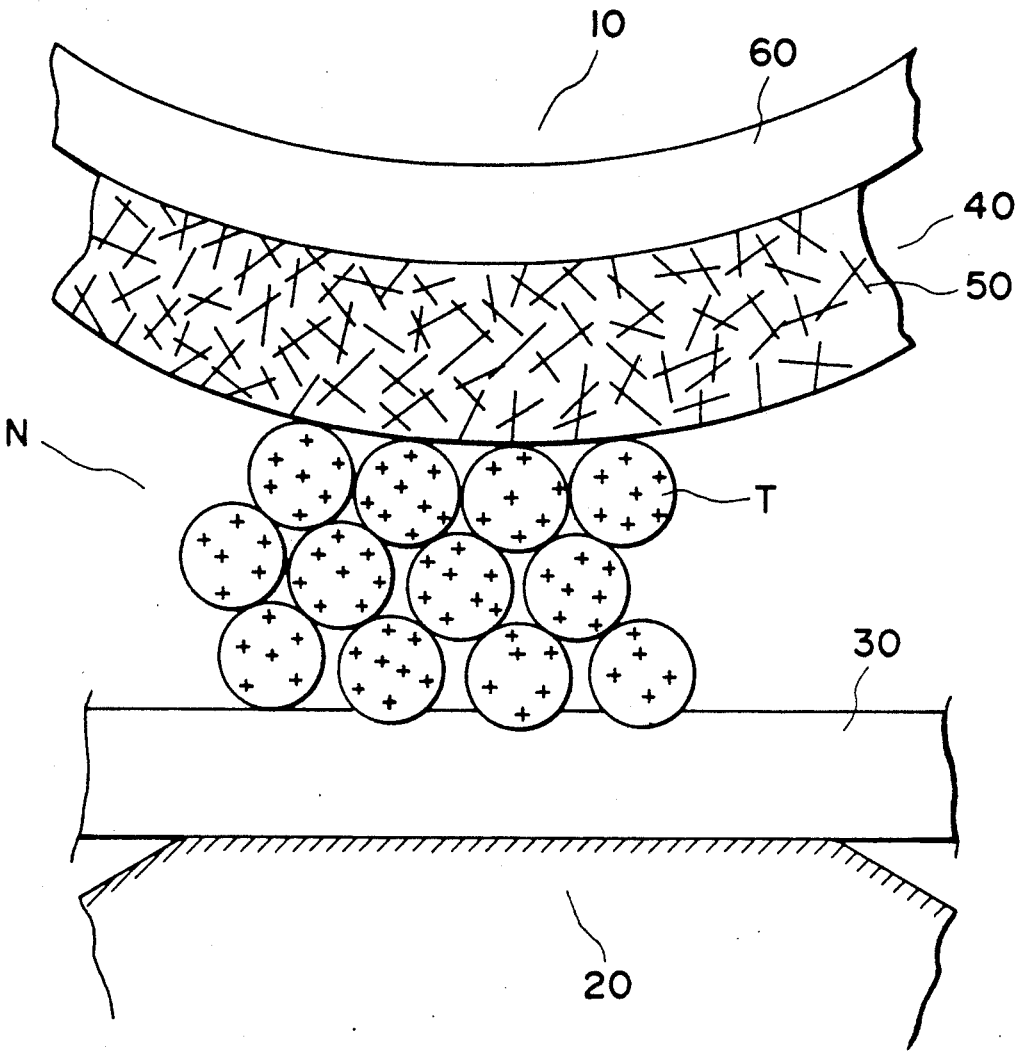
FIG. 3 is a cross-sectional view at a nip portion of an image fixing device according to an embodiment of the present invention.

FIG. 3 is an enlarged and somewhat schematic cross-sectional view of the upper roller 10 and the lower roller 20 at the nip N. However, the recording material is caught by the nip.

Figure 1:
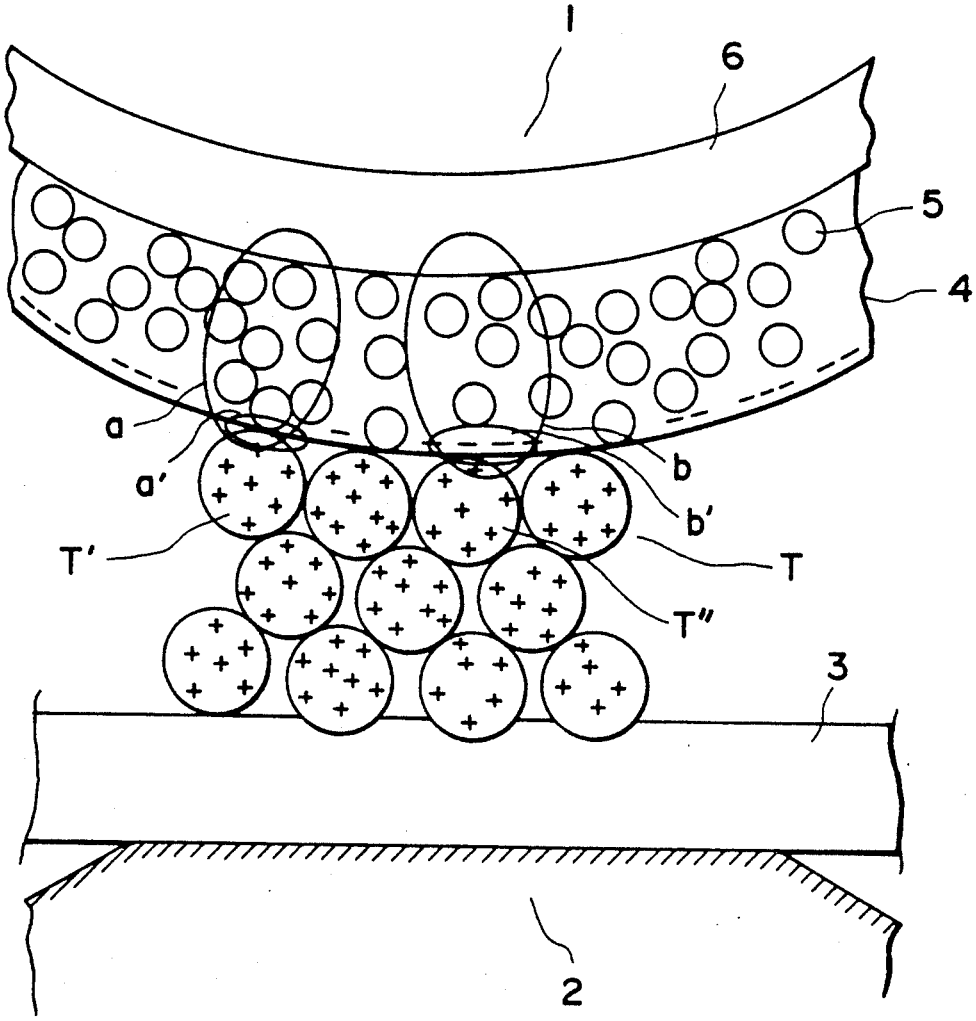
FIG. 1 PRIOR ART
FIG. 1 is a sectional view of a conventional fixing device.

In this Figure, the recording material having the toner image T is indicated by a reference 30. The upper roller is coated with a releasing resin layer 40, and includes a core metal 60. Into the resin layer 40, straight needle like single-crystal fibers 50 which will hereinafter be also called "whisker single-crystal fibers" or "whisker fibers", are mixed, as shown in the Figure. More particularly, the whisker fibers 50 having a relatively low volume resistivity are added and uniformly dispersed in the resin layer 40 made of fluorine resin or the like. Ends of the whisker fibers are extended to the surface of the roller or to the core metal, while at the same time the fibers are entangled in a complicated manner in the resin layer, and therefore, it is considered that a large number of electric contacts are established. For this reason, as contrasted to the case of conventional art shown in FIG. 1, a great number of conductive paths are formed with the result that the electric charge on the roller surface is easily discharged. Additionally, since the single-crystal fibers are in the form of needles, the electric charge on the roller surface is easily discharged to the end of the single-crystal fibers. Also, the single-crystal fibers are straight, so that the ends of extremely many fibers are exposed at or close to the surface of the roller.

Accordingly, the electric charge produced by the triboelectrification at the roller surface is not stagnated at the roller surface but is discharged to the core metal 60, whereby the roller surface is uniformly discharged even if it is seen microscopically. This decreases the electrostatic attraction force between the toner T and the roller, and therefore, greatly decreases the toner off-set due to triboelectrification.

Since in this embodiment, whisker single-crystal fibers, not usual low resistance fibers, are added, which have higher mechanical strength, the strength and the hardness of the resin layer is enhanced. Also, under the severe operational conditions experienced in the fixing device, the whisker single-crystal fibers can provide and maintain the heat-resistance and durability for a long period of time. For example, when usual fibers such as carbon fibers are used, the surface is easily worn, by which the roller surface is roughened relatively soon, and therefore the toner off-set is easily occurred although the electric resistance of the roller itself is reduced. According to the present embodiment employing the whisker single-crystal fibers, the smoothness of the roller surface can be maintained for a long period of time. Thus, the roller discharging effect, and therefore, the off-set preventing effect can be maintained for a long period of time.

The effectiveness of the function of the whisker fibers increases with decrease of the electric resistance thereof, but it has been found that the fibers are effective if the volume resistivity is not more than $10^{10}$ ohm.cm.

The length of the whisker fibers should not be too short, since if so they become similar to conventional particles, but should not be too long since if so the smoothness of the resin layer is degraded to deteriorate the close-contactness between the roller surface and the recording material, thus preventing good image fixing operation. It has been found that 5–30 microns of the average length is preferable.

A lower content of the whisker single-crystal fibers would be better since then the resin content as the base material of the roller surface layer is not reduced, that is, the releasing property can be maintained. On the other hand, the lower content of the fibers results in reduced contacts between fibers, and therefore, the electric resistance of the resin layer is not effectively reduced. With the increase thereof, the releasability is more degraded. In view of these considerations, the content of the whisker single-crystal fiber is 2–20% by weight with respect to the releasing resin.

As for the resin for the roller surface base material, fluorine resins having a releasing property such as PFA or PTFE are suitable, and as for the material of the whisker single-crystal fiber, potassium titanate whisker, silicon carbide whisker or carbon whisker or the like are suitable.

In the description of the foregoing embodiment, the whisker fibers 50 are dispersed in the entire resin layer 40 formed on the core metal 60, but the structure of the layer on the core metal is not limited to this. What is most important in this embodiment is that the electric charge resulting from the triboelectrification is prevented from stagnating at least at the surface of the roller or the surface layer. To achieve this, the resin layer contains the whisker fibers. Therefore, when the roller is provided with plural resin or elastic layers on the core metal, it is possible that the whisker fibers are contained at least in the outermost layer having the releasable property.

Referring to FIG. 4, there is shown an enlarged nip portion of the fixing device structured in the above described manner. The upper roller 1 includes a core metal 60, a heat-resistive elastic layer made of silicone rubber or the like 70 and a fluorine resin layer 40 functioning as a releasing surface layer on the elastic layer. The whisker fibers 50 are contained at least in the surface layer 40. Similarly to the foregoing embodiment, the triboelectric charge produced on the resin layer surface is discharged to the interface between itself and the elastic layer 40 or into the elastic layer 30, so that the electric charge is not stagnated on the roller surface, and therefore, the electrostatic toner off-set is remarkably reduced.

The same thing applies to the case in which the layer 70 is not an elastic layer but another resin layer (for example, a bonding layer).

Figure 4A:
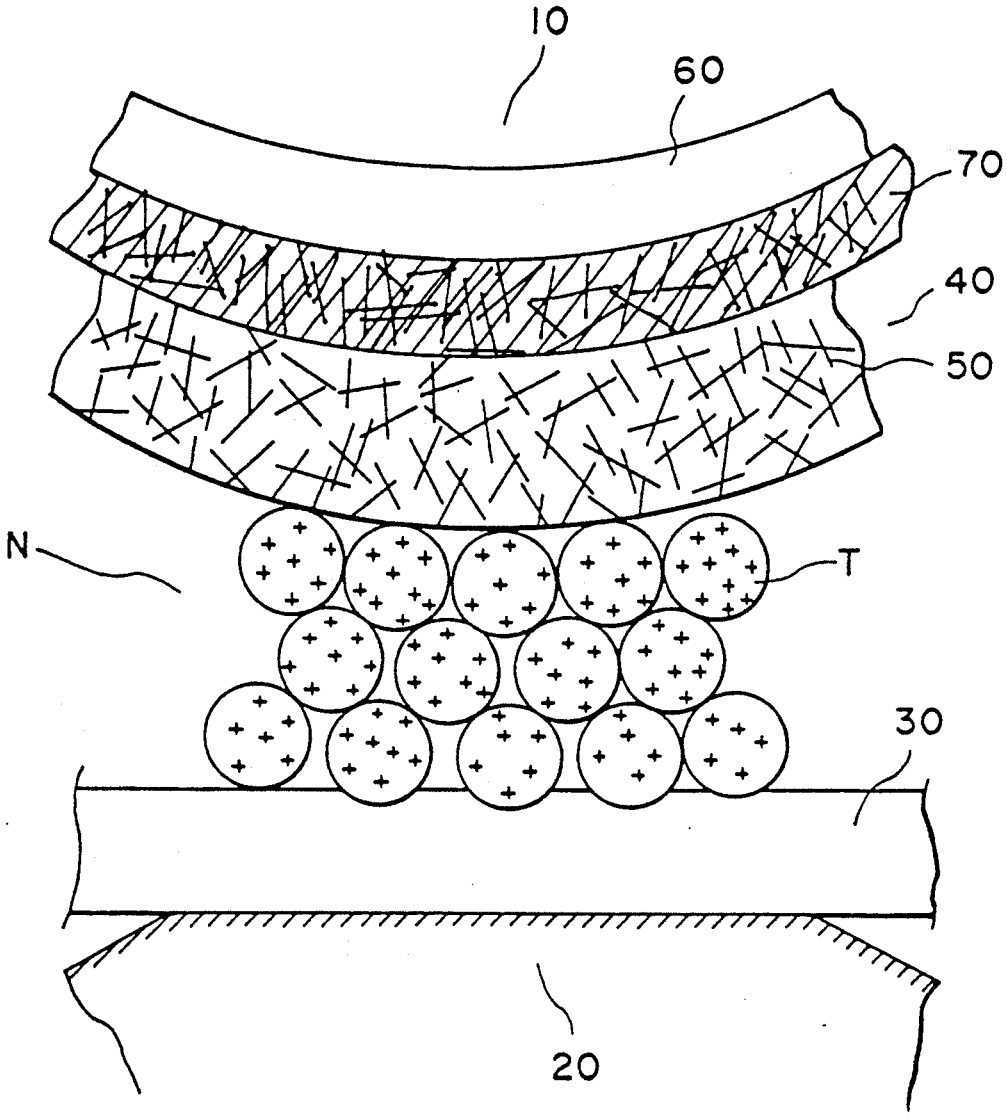
FIG. 4A is a cross-sectional view of a nip portion of an image fixing device according to another embodiment of the present invention.

In order to discharge the electric charge which has been introduced to the lower layer 70 to the core metal 60, the lower layer 70 preferably contains low electric resistance material, for example, the whisker single-crystal fibers, as illustrated in FIG. 4A.

In the foregoing embodiments, it is further preferable that the core metal of the roller is electrically grounded so as to conveniently discharge the electric charge stagnating in the core metal. In this case, the roller core metal may be directly grounded, or may be grounded through a predetermined resistance.

Figure 5:
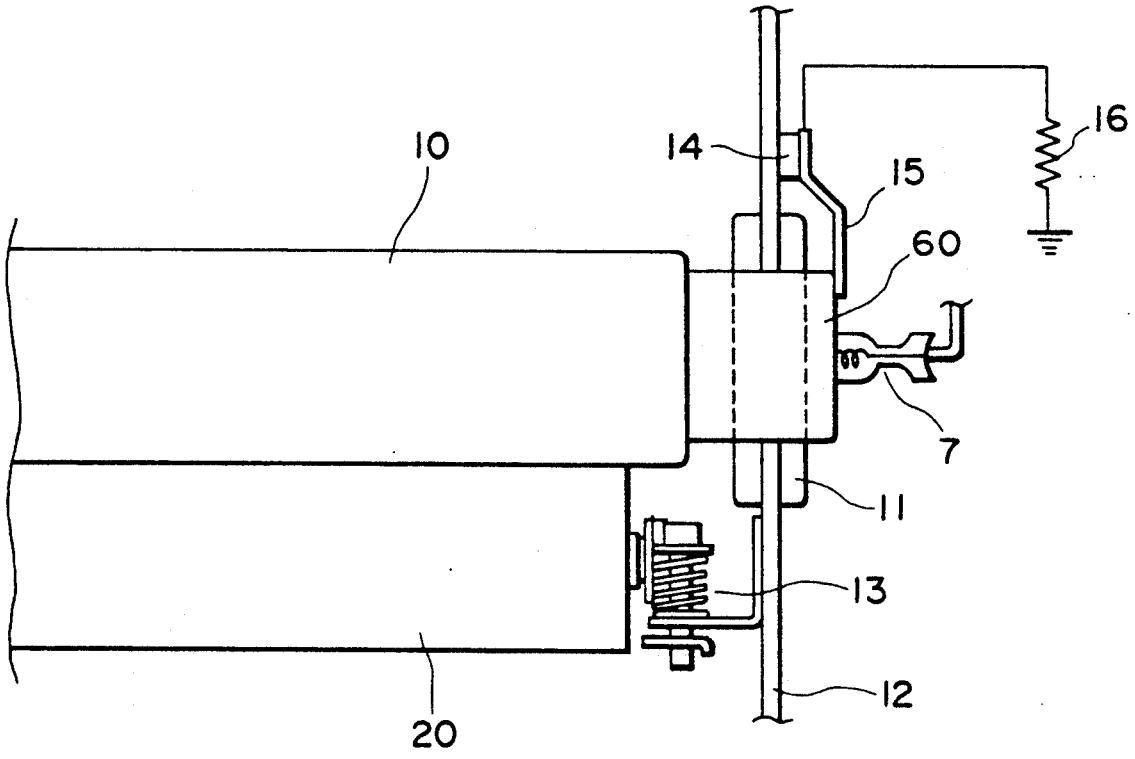
FIG. 5 is a front view of an image fixing device illustrating a roller grounding means.

FIG. 5 shows an example wherein the core metal is grounded through a resistance. As shown, the core metal 60 of the upper roller 10 is rotatably supported in a side plate 12 of an image forming apparatus or an image fixing apparatus using a bearing 11. The lower roller 20 is pressed to the upper roller 10 by a suitable pressing means (a pressing spring 13 in the shown Example) to provide a desired nip width. The bearing 11 is made of heat-resistive resin having an electrically insulating property, wherefore the side plate 12 and the roller core metal 60 are electrically insulated. To a longitudinal end surface of the core metal 60, a leaf spring 15 is normally contacted. The spring 15 is made of a conductive material and is fixed at the other end to the side plate or a frame of the image forming apparatus through an insulating resin 14. The spring 15 is grounded through a resister of not more than $10^{12}$ ohm. With this structure, the triboelectric charge discharged into the core metal 60 of the upper roller 10 is further discharged through the leaf spring 15, by which the surface of the upper roller 10 is not charged extremely. In this sense, this is a further preferable embodiment. In this embodiment, a combination of a leaf spring and a resistor is employed, but this can be modified by, for example, making the bearing 11 from a resin material having a semiconductive property to discharge the electric charge through the bearing to the grounded side plate 12. For the purpose of effectively discharging the electric charge, it is not always necessary to directly ground the roller, but the roller is electrostatically grounded through a resistor having a resistance of not more than $10^{12}$ ohm. Description will be made as to experiments using the present invention and not using the present invention.

EXAMPLES 1–3

A fluorine resin primer (POLYFLON EK-1980 GY, available from Daikin Kogyo Kabushiki Kaisha, Japan) and a filler shown in Table 1 were mixed and sufficiently stirred, and PTFE resin dispersing liquid (POLYFLON E-4300 CR, available from Daikin Kogyo Kabushiki Kaisha, Japan) and a filler shown in Table 1 were mixed and sufficiently stirred to produce a paint. An aluminum pipe having a diameter of 40 mm was manufactured to a roller base. The surface thereof was homed by #100 alumina powder to be roughened. The above primer was applied in the thickness of 10 microns and was dried for 20 minutes at 150° C. Further, the above described paint was applied in the thickness of 20 microns and was sintered at 390° C. for 20 minutes.

The fixing roller thus provided was mounted into an fixing device of a copying machine (NP-3525, available from Canon Kabushiki Kaisha, Japan), and durability test were performed, in which the contamination of the roller was observed after 1000 sheets of plain paper of JIS A4 size were fixed, and damage or score on the surface of the roller was observed after 30,000, 50,000 and 70,000 sheets were fixed, respectively. It was confirmed that when the resin surface was damaged, the amount of the off-set toner was so increased that the roller contamination was no longer negligible, and also, the recording materials were relatively easily wrapped around the roller.

TABLE 1

| | Filler | Vol. resistivity (Ω.cm) | Length (μm) | Content wt. % | Contamination | Damage (No. of sheets × $10^4$) 3 | 5 | 7 | Evaluation |
|---|---|---|---|---|---|---|---|---|---|
| Example 1 | (Reduction sintering) Potassium titanate s-c fibers | $10^4$ | 10 | 10 | E | E | E | G | E |
| Comparison Example 1 | (Reduction sintering) Potassium titanate fibers | $10^4$ | 10 | 10 | E | N | N | N | N |
| Comparison Example 2 | Potassium titanate powder | $10^4$ | (size) 1 | 10 | N | N | N | N | N |
| Example 2 | Silicon carbide s-c fibers | $10^2$ | 10 | 10 | E | E | G | G | E |
| Comparison Example 3 | Silicon carbide fibers | $10^2$ | 10 | 10 | E | N | N | N | N |
| Comparison Example 4 | Silicon carbide powder | $10^2$ | (size) 1 | 10 | N | N | N | N | N |
| Example 3 | Carbon s-c fibers | $10^1$ | 10 | 10 | E | E | G | G | E |
| Comparison Example 5 | Carbon fibers | $10^1$ | 10 | 10 | E | N | N | N | N |
| Comparison Example 6 | Carbon powder | $10^1$ | (size) 0.5 | 10 | N | N | N | N | N |

E: usable, G: barely usable with small problem, N: non-usable

EXAMPLES 4–10

Single-crystal fibers of potassium titanate were added to the primer and the paint used in Example 1 in the amount shown in Table 2. The electric resistances of the fibers are made different by surface treatment with thin oxide ($SnO_2$).

The fixing roller was manufactured in the same manner but using the above primer and the paint. The results of durability tests are shown in Table 2.

TABLE 2

| Example | Vol. resistivity (Ω.cm) | Length (μm) | Content wt. % | Contamination | Damage (No. of sheets × $10^4$) 3 | 5 | 7 | Evaluation |
|---|---|---|---|---|---|---|---|---|
| 4 | $10^{12}$ | 10 | 10 | G | E | E | G | G |
| 5 | $10^{10}$ | 10 | 10 | E | E | E | G | E |
| 6 | $10^6$ | 10 | 10 | E | E | E | G | E |
| 7 | $10^4$ | 10 | 10 | E | E | E | G | E |
| 8 | $10^2$ | 10 | 10 | E | E | E | G | E |
| 9 | $10^{-1}$ | 10 | 10 | E | E | E | G | E |
| 10 | $10^{-2}$ | 10 | 10 | E | E | E | G | E |

EXAMPLES 11–16

Single-crystal fibers of potassium titanate having different average lengths and having a resistance lowered by reduction sintering ($10^4$ ohm.cm) were added to the primer and the paint used in Example 1 in the amount shown in Table 3.

. A fixing roller was manufactured in the same manner as with Example 1 but using the above primer and the paint, and the durability tests were performed. The results thereof are shown in Table 3.

TABLE 3

| Example | Length (μm) | Content wt. % | Contamination | Damage (No. of sheets × $10^4$) 3 | 5 | 7 | Evaluation |
|---|---|---|---|---|---|---|---|
| 11 | 4 | 10 | G | G | G | G | G |
| 12 | 5 | 10 | E | E | G | G | E |
| 13 | 10 | 10 | E | E | E | G | E |
| 14 | 20 | 10 | E | E | E | G | E |
| 15 | 30 | 10 | E | E | G | G | E |
| 16 | 35 | 10 | G | G | G | G | G |

EXAMPLES 17–28

Single-crystal fibers of potassium titanate having a length of 10 microns and having a resistance lowered by reduction sintering ($10^4$ ohm.cm) were added to a fluorine resin primer (POLYFLON EK), were added to PTFE dispersion (POLYFLON E-4300 CR) (base material for a first resin layer) and were added to PFA dispersion (NEOFLON AD-1, available from Daikin Kogyo Kabushiki Kaisha, Japan) (base material for a second resin layer) in the amounts shown in Table 4.

The fixing roller was manufactured in the same manner but using the above primer and the paint. The results of durability tests are shown in Table 4.

TABLE 4

| Example | Resin | Content of potassium titanate s-c fibers (%) | Contamination | Damage (No. of sheets × $10^4$) 3 | 5 | 7 | Evaluation |
|---|---|---|---|---|---|---|---|
| 17 | PTFE | 1 | G | E | G | G | G |
| 18 | " | 2 | G | E | E | G | E |
| 19 | " | 10 | E | E | E | G | E |
| 20 | " | 15 | E | E | E | G | E |
| 21 | " | 20 | G | E | E | G | E |
| 22 | " | 25 | G | E | G | G | G |
| 23 | PFA | 1 | G | E | G | G | G |
| 24 | " | 2 | G | E | E | G | E |
| 25 | " | 10 | E | E | E | G | E |
| 26 | " | 15 | E | E | E | G | E |
| 27 | " | 20 | E | E | G | G | E |
| 28 | " | 25 | G | G | G | G | G |

In the foregoing embodiments, the whisker fibers are added in the resin coating layer having the releasing property of the upper roller, that is, the roller contactable to the unfixed toner image. However, the addition is not limited to the upper roller. The description will be made as to the embodiments wherein the present invention is incorporated in the lower roller, that is, a pressing roller.

Recently, a duplex image forming function wherein images can be formed on both sides of a recording medium, in an image forming apparatus such as an electrophotographic apparatus, have been developed. In such an apparatus, as contrasted to the conventional apparatus, the lower roller (pressing roller) is contacted to an already fixed image, and therefore, a problem that the recording material is wrapped around the lower roller or that the fixed toner is re-fused in the nip and is deposited onto the surface of the lower roller (off-set) tends to arise. To obviate the problem, the lower roller is also provided with a resin surace layer having the releasing property.

For example, fluorine rubber latex containing a fluorine resin component is applied as a thin layer on a heat-resistive elastic material (silicone rubber or the like) which is in turn on the core metal, or the heat-resistive elastic material is coated with a tube of fluorine resin material. The following embodiment includes the resin surface layer containing whisker single-crystal fibers.

When the releasability of the lower roller is required, the lower roller 20 is provided with a resin surface layer 100 having the releasing property and made of fluorine resin or the like on the heat resistive elastic material 80 of silicone rubber or the like on the core metal 90, in an attempt to prevent the recording material 30 from being wrapped around the lower roller and to prevent the fixed toner image from being deposited onto the surface of the lower roller 20. Similarly to the above described embodiment, however, when positively chargeable toner is used, the resin coating layer shows a very strong negative-charging property, whereby the toner which is fused by contact with the resin layer at the nip N is partly deposited onto the lower roller by the electrostatic attraction force. Often, by the force for attracting the toner to the roller, the recording material 30 strongly attached to the image is simultaneously attracted to the roller so as to be wrapped around the roller.

To avoid this, the whisker fibers are added to the coating layer of the lower roller.

Figure 6:
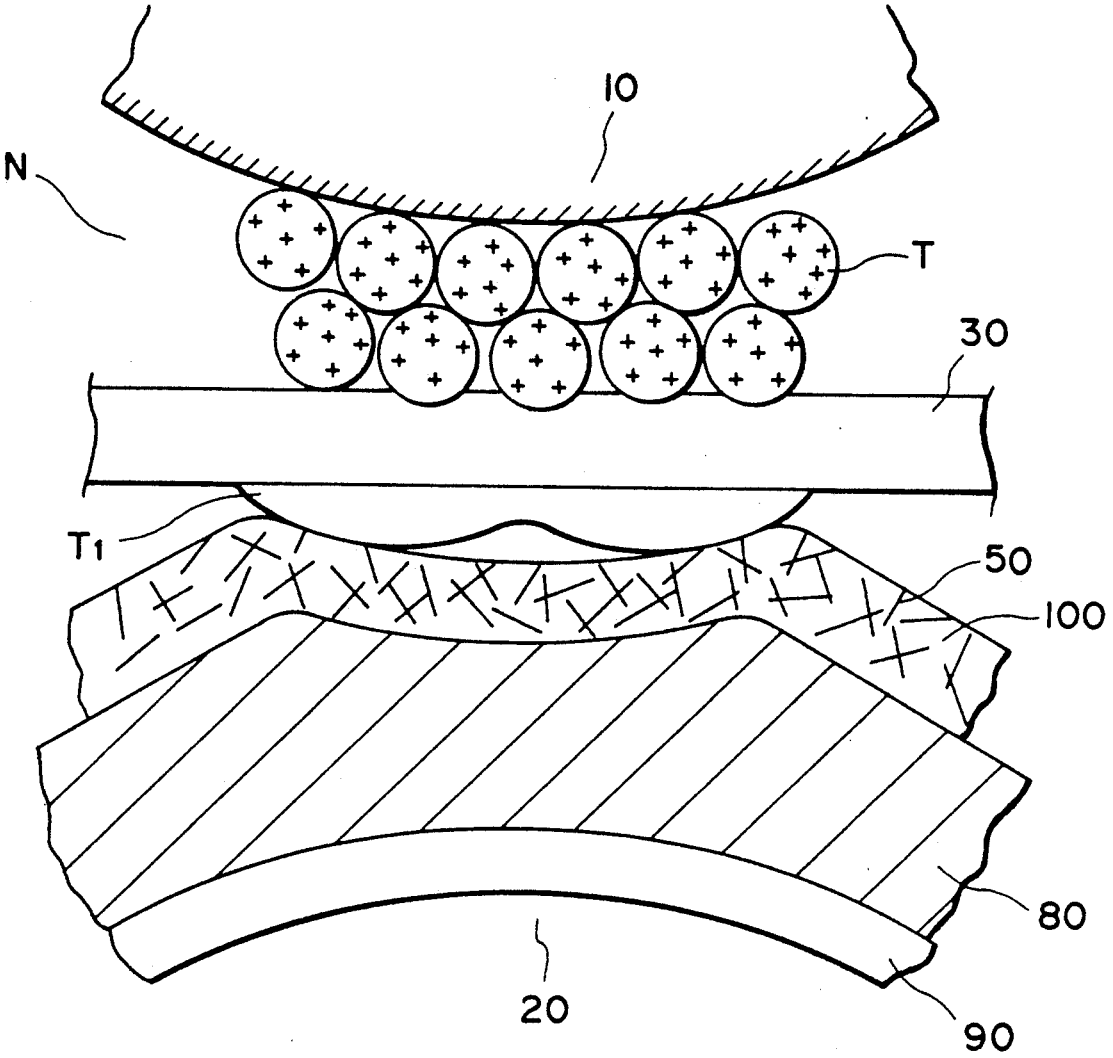
FIG. 6 is a cross-sectional view of a nip portion of an image fixing device according to a further embodiment of the present invention.

Referring to FIG. 6, there is shown an enlarged sectional view of the nip portion in an image fixing device according to this embodiment, wherein the lower roller 20 includes an elastic layer 80 made of silicone rubber, for example, and a resin coating layer 100 made of a fluorine resin such as PTFE or PFA containing the above described whisker single-crystal fibers uniformly dispersed therein. By this, similarly to the above described embodiment, the triboelectric charge is reduced between the lower roller 20 and the recording material 30 or the fixed toner image T1, and the electric charge on the resin layer is easily discharged to the elastic layer, whereby the amount of electric charge remaining on the surface is reduced, and additionally, the electrostatic force between the toner image and the surface of the resin layer is reduced. Therefore, even if the fixed toner image T1 is re-fused in the nip N, it does not transfer to the coating resin layer surface of the lower roller, or the recording material 30 is not wrapped around the lower roller. And, this function can be accomplished with a relatively small amount of whisker fibers added, the releasing property of the coating layer is not degraded, and simultaneously, the resin layer is reinforced. As a result, the durability of the roller is remarkably increased.

In the foregoing description, the toner was positively chargeable, but the off-set reducing effect applies to negatively chargeable toner. If the lower roller is simply coated with fluorine resin layer on the elastic layer, as in a conventional device, the resin layer is strongly charged to the negative polarity, and a strong electrostatic repelling force is produced between the lower roller and the unfixed toner image T on the recording material 30 as well as the fixed toner T1. Accordingly, the toner T is urged to the upper roller 10, and a part thereof is deposited onto the upper roller surface. Where, however, the lower roller shown in FIG. 6 is used, the electric charge remaining on the resin layer of the lower roller is reduced, the electrostatic repelling force is reduced, whereby the off-set of the toner T to the upper roller 10 is remarkably reduced.

In the foregoing explanation, the whisker fibers are added into the resin coating layer only. In order to reduce the triboelectric charge on the lower roller, it is preferable to decrease the electric resistance of the elastic layer, too. For this purpose, the silicone rubber (methylvinylsilicone, nitrosilicone rubber) is preferably made to have a low resistance, or it preferably contains whisker fibers according to this invention.

By adding the whisker single-crystal fibers into the resin coating layer of the lower roller, the contamination of the lower roller has been improved to such an extent that no practical problem is involved.

In this embodiment, it is preferable that the lower roller is electrically grounded directly or through a resistor using same means as with the upper roller in FIG. 5 embodiment in order to further increase the charge removing speed.

In the foregoing embodiments, the whisker fibers are added to the resin coating layer of the upper roller or the lower roller. However, they may be contained in both of the rollers.

In addition to the whisker single-crystal fibers, low resistance particles having a volume resistivity of not more than $10^{10}$ ohm.cm may be added to the surface layer of the roller. Such particles in the base material of the surface layer establish an extremely large number of electrically conductive paths by contact among themselves or with the whisker fibers to contribute to the increase of the charge removed from the roller surface. Also, particles of material having Vickers hardness of not less than 2000 kg/mm$^2$ are added into the surface layer in addition to the whisker single-crystal fibers, by which the wear resistance of the surface layer is increased, and the off-set preventing effect is also enhanced. As for the material of those particles, titanium nitride powder, silicon carbide powder, titanium carbide powder, tungsten carbon powder are usable.

Where the whisker fibers and particles are added to the resin surface layer of the roller, the fiber content with respect to the resin layer (% by weight) is preferably larger than the particle content with respect thereto (% by weight). By doing so, the degrading of the releasability of the resin can be effectively prevented. The contents of the whisker fibers and the particles with respect to the surface layer resin is preferably not less than 3% by weight and not more than 20% by weight in total. The total (fibers plus particles) is preferably not more than 20 by weight, since then the decreasing of the releasability of the resin can be effectively prevented, and the content of the fibers or the particles is preferably not less than 3% by weight, since then the discharging effect is sufficiently increased so that the off-set can be effectively prevented, and simultaneously the wear resistance is increased by which the off-set prevention is enhanced.

As described in the foregoing, according to the present invention, the charge removing effect from the surface of the fixing roller is enhanced; the wear resistance is enhanced; and therefore, the charge removing effect can be maintained for a long period of time, and therefore, the off-set preventing effect is sufficient; and the off-set preventing effect can be maintained for the long period of time.

While the invention has been described with reference to the structures disclosed herein, it is not confined to the details set forth and this application is intended to cover such modifications or changes as may come within the purposes of the improvements or the scope of the following claims.

What is claimed is:

1. A roller for fixing a toner image on a recording material, comprising:

a base member; and a surface layer outside said base member, said surface layer containing low resistance fibers which are single-crystal fibers, wherein the fibers have lengths of 5–30 microns.

2. A roller for fixing a toner image on a recording material, comprising:

a base member; and a surface layer outside said base member, said surface layer containing low resistance fibers which are single-crystal fibers, wherein a content of the fibers is 2–20% by weight with respect to base material of the surface layer.

3. A roller for fixing a toner image on a recording material, comprising:

a base member; and a surface layer outside said base member, said surface layer containing low resistance fibers which are single-crystal fibers, wherein said surface layer has a base material of fluorine resin.

4. A roller according to claim 3, wherein said surface layer has a base material of polytetrafluoroethylene resin.

5. A roller according to claim 3, wherein said surface layer has a base material of perfluoroalkoxy resin.

6. A roller for fixing a toner image on a recording material, comprising:

a base member; and a surface layer outside said base member, said surface layer containing low resistance fibers which are single-crystal fibers, wherein said fibers are of potassium titanate treated to be made a low resistance fibers.

7. A roller for fixing a toner image on a recording material, comprising:

a base member; and a surface layer outside said base member, said surface layer containing low resistance fibers which are single-crystal fibers, wherein said fibers are of carbon.

8. A roller for fixing a toner image on a recording material, comprising:

a base member; and a surface layer outside said base member, said surface layer containing low resistance fibers which are single-crystal fibers, further comprising an intermediate layer between said base member and said surface layer, wherein said intermediate layer contains straight-needle like single-crystal fibers mixed thereinto.

9. A roller according to claim 1, 2, 3, 7, or 8, wherein the fibers have a volume resistivity of not more than $10^{10}$ ohm. cm.

10. A roller according to claim 1, 2, 3, 7 or 8, wherein said fibers are of silicon carbide.

11. An image fixing apparatus for fixing a toner image on a recording material, comprising:

a rotatable roller for being press-contacted to the recording material, said roller comprising:

a base member; and a surface layer outside said base member, said surface layer containing low resistance fibers which are single-crystal fibers.

12. An apparatus according to claim 11, wherein the fibers have a volume resistivity of not more than $10^{10}$ ohm.cm.

13. An apparatus according to claim 11, wherein the fibers have lengths of 5–30 microns.

14. An apparatus according to claim 11, wherein a content of the fibers is 2–20% by weight with respect to base material of the surface layer.

15. An apparatus according to any one of claims 11–14, wherein said surface layer has a base material of fluorine resin.

16. An apparatus according to claim 15, wherein said surface layer has a base material of polytetrafluoroethylene resin.

17. An apparatus according to claim 15, wherein said surface layer has a base material of perfluoroalkoxy resin.

18. An apparatus according to any one of claims 11–14, wherein the fibers are of potassium titanate treated to be made a low resistance fibers.

19. An apparatus according to any one of claims 11–14, wherein said fibers are of silicon carbide.

20. An apparatus according to any one of claims 11–14, wherein said fibers are of carbon.

21. An apparatus according to claim 11, further comprising an intermediate layer between said base member and said surface layer, wherein said intermediate layer contains single-crystal low resistance fibers.

22. An apparatus according to claim 11, further comprising means for electrically grounding said roller.

23. An apparatus according to claim 11, further comprising means for electrically grounding said roller through resistor means.

24. An apparatus according to claim 11, further comprising an other rotatable roller press-contactable to said rotatable roller, wherein said other rotatable roller has a surface layer containing single-crystal low resistance fibers.

25. An apparatus according to claim 24, wherein said first rotatable roller has a base material of resin and said other rotatable roller has a base material of rubber.

26. An apparatus according to claim 11, wherein said low resistance fibers are provided by deoxidizing high resistance single-crystal fibers.

27. An apparatus according to claim 26, wherein said fibers are oxide material.

28. An apparatus according to claim 26, wherein said low resistance fibers are provided by deoxidizing and sintering high resistance single-crystal fibers.

29. An apparatus according to claim 11, wherein said low resistance fibers are provided by coating surfaces of high resistance single-crystal fibers with low resistance material.

30. An apparatus according to claim 11, wherein the surface layer containing the single-crystal fibers further contains low resistance particles.

31. An apparatus according to claim 30, wherein the surface layer contains a lower content of the low resistance particles than of the single-crystal fibers.

32. An apparatus according to claim 30, wherein the contents of the single-crystal fibers and the low resistance particles are each not less than 3% by weight, and a total content thereof is not more than 20% by weight.

33. A roller for fixing a toner image on a recording material, comprising:

a base member; and a surface layer outside said base member, said surface layer containing low resistance fibers which are single-crystal fibers, wherein said low resistance fibers are provided by deoxidizing high resistance single-crystal fibers.

34. A roller according to claim 33, wherein said fibers are oxide material.

35. A roller according to claim 33, wherein said low resistance fibers are provided by deoxidizing and sintering high resistance single-crystal fibers.

36. A roller for fixing a toner image on a recording material, comprising:

a base member; and a surface layer outside said base member, said surface layer containing low resistance fibers which are single-crystal fibers, wherein said low resistance fibers are provided by coating surfaces of high resistance single-crystal fibers with low resistance material.

37. A roller for fixing a toner image on a recording material, comprising:

a base member; and a surface layer outside said base member, said surface layer containing low resistance fibers which are single-crystal fibers, wherein the surface layer containing the single-crystal fibers further contains low resistance particles.

38. A roller according to claim 37, wherein the surface layer contains a lower content of the low resistance particles than of the single-crystal fibers.

39. A roller according to claim 37, wherein the contents of the single-crystal fibers and the low resistance particles are each not less than 3% by weight, and a total content thereof is not more than 20% by weight.

* * * * *

UNITED STATES PATENT AND TRADEMARK OFFICE

CERTIFICATE OF CORRECTION

PATENT NO. : 5,045,891 Page 1 of 2

DATED : September 3, 1991

INVENTOR(S) : Senba, et al.

It is certified that error appears in the above-identified patent and that said Letters Patent is hereby corrected as shown below:

ON THE TITLE PAGE:

[73],

"Assignee: CANON KABUSHIKI KAISHA & SUMITOMO ELECTRIC IND., INC., Tokyo, Japan" should read --Assignees: CANON KABUSHIKI KAISHA, Tokyo; SUMITOMO ELECTRIC INDUSTRIES, LTD., Osaka, both of Japan--.

[56] References Cited OTHER PUBLICATIONS,
Line 2, "Fluorobarbon" should read --Fluorocarbon--.

[57] ABSTRACT,
Line 1, "in which" should read --passes--.

SHEET 4 of 6,
Add Figure 4 as follows:

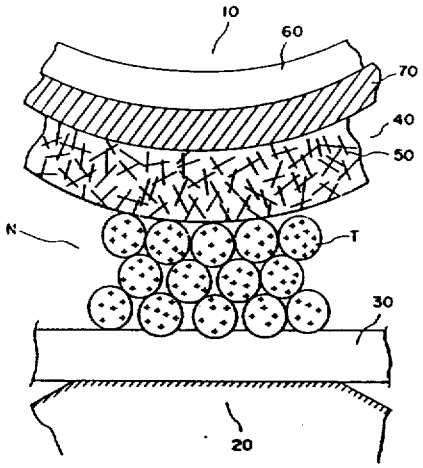

FIG. 4

UNITED STATES PATENT AND TRADEMARK OFFICE

CERTIFICATE OF CORRECTION

PATENT NO. : 5,045,891

DATED : September 3, 1991

INVENTOR(S) : Senba, et al.

It is certified that error appears in the above-identified patent and that said Letters Patent is hereby corrected as shown below:

COLUMN 1,
Line 13, "most" should read --the most--;
Line 25, "types one" should read --types: one--; and
Line 52, "power" should read --powder--.

COLUMN 2,
Line 9, "handreds" should read --hundreds--.

COLUMN 6,
Line 50, "homed" should read --honed--.

COLUMN 7,
Line 29, "thin" should read --tin--.

COLUMN 12,
Line 59, "an other" should read --another--.

Signed and Sealed this

Tenth Day of November, 1992

*Attest:*

*Attesting Officer*

DOUGLAS B. COMER

*Acting Commissioner of Patents and Trademarks*